United States Patent [19]

Theurer et al.

[11] Patent Number: 4,809,614

[45] Date of Patent: Mar. 7, 1989

[54] MOBILE TIE GANG APPARATUS

[75] Inventors: Josef Theurer, Vienna; Johann Hansmann, Klosterneuburg; Herbert Wörgötter, Linz, all of Austria

[73] Assignee: Franz Plasser Bahnbaumaschinen-Industriegesellschaft m.b.H., Vienna, Austria

[21] Appl. No.: 165,539

[22] Filed: Mar. 8, 1988

[30] Foreign Application Priority Data

Jul. 23, 1987 [AT] Austria ..... 1876/87

[51] Int. Cl.[4] ..... E01B 29/10

[52] U.S. Cl. ..... 104/7.2; 104/9; 104/12; 104/279

[58] Field of Search ..... 104/2, 7.1, 7.2, 8, 104/9, 10, 12, 16, 279, 307

[56] References Cited

U.S. PATENT DOCUMENTS

| | | | |
|---|---|---|---|
| 4,175,902 | 11/1979 | Herzog et al. . | |
| 4,190,394 | 2/1980 | Herzog et al. . | |
| 4,253,398 | 3/1981 | Theurer et al. . | |
| 4,301,738 | 11/1981 | Theurer . | |
| 4,534,295 | 8/1985 | Theurer . | |
| 4,611,541 | 9/1986 | Theurer . | |
| 4,635,557 | 1/1987 | Mohr et al. | 104/12 X |

FOREIGN PATENT DOCUMENTS

| | | | |
|---|---|---|---|
| 2230202 | 8/1973 | Fed. Rep. of Germany . | |
| 91209 | 8/1978 | Japan | 104/9 |

OTHER PUBLICATIONS

"Progressive Railroading", Feb. 78, p. 68; Mar. 84, pp. 93/4; Feb. 86, pp. 45/6.

"Railway Track Structures", Dec. 68, pp. 14–16; Jun. 78, pp. 28, 29 and 31; Nov. 83, pp. 22–24; Sep. 85, pp. 49, 54, 58, 61, 66, 105 and 106.

*Primary Examiner*—Robert B. Reeves
*Assistant Examiner*—Frank H. Williams, Jr.
*Attorney, Agent, or Firm*—Kurt Kelman

[57] ABSTRACT

A mobile apparatus for sequentially exchanging selected consecutive groups of old ties in an existing railroad track for groups of new ties while retaining groups of old ties therebetween to support the mobile apparatus on the track, which comprises a continuously advancing bridge-like work vehicle having a machine frame defining an upwardly recessed portion between respective ends thereof and a respective swivel truck supporting each machine frame end. A continuous guide track is mounted atop the work vehicle and a power-driven tie transporting crane is mounted for mobility on the guide track. A succession of different individual devices are mounted in the recessed portion of the work vehicle machine frame and operative to effectuate different sequential operations for exchanging the selected old ties for the new ties, the tie exchanging devices including in sequence in the operating direction (1) a spike pulling device, (2) a spike collecting device for collecting the pulled spikes, (3) a ballast clearing device including tools for lifting the railroad track lifting and for laterally moving the old ties wherefrom the spikes have been pulled, (4) a tie plate transporting device, (5) a tie pulling device for laterally withdrawing the laterally moved old ties from the railroad track and a vertical conveyor succeeding the tie pulling device for conveying the withdrawn old ties, (6) a tie inserting device for inserting the new ties and a vertical conveyor preceding the tie inserting device for conveying the new ties thereto, and (7) a device for tamping ballast under the inserted new ties. A respective drive longitudinally displaces each tie exchanging device.

20 Claims, 4 Drawing Sheets

MOBILE TIE GANG APPARATUS

BACKGROUND OF THE INVENTION

1. Field of the Invention

The present invention relates to a mobile apparatus or machine combination for sequentially exchanging selected consecutive groups of old ties in an existing railroad track, for example every third or fourth tie of the track or groups of, say, three adjacent old ties, for groups of new ties while retaining groups of, say, three adjacent old ties therebetween to support the mobile apparatus on the track, by means of a succession of different individual devices operatively coordinated to effectuate different sequential operations for exchanging the selected old ties for the new ties. Preferably, this apparatus is combined with a train for loading, transporting and unloading the ties on, in and from open top railroad cars.

2. Description of the Prior Art

U.S. Pat. No. 4,253,398, dated Mar. 3, 1981, discloses a mobile apparatus for the continuous sequential replacement of all old ties of a track with a track renewal train which removes the old ties and lays the new ties while the track rails are lifted and spread apart.

U.S. Pat. No. 4,611,541, dated Sep. 16, 1986, discloses a continuously advancing ballast cleaning machine with tie replacement devices, wherein the ballast is excavated, cleaned and returned while the track is raised a substantial amount. The tie pulling and inserting devices are mounted between the swivel trucks supporting the respective ends of the ballast cleaning machine frame and are connected to longitudinal displacement drives. These devices are used only when an obstacle hindering the operation of the ballast excavating chain is encountered on the shoulder of the track, i.e. they are merely auxiliary means in the ballast cleaning machine for occasional use. No control or control cab for operation of the auxiliary tie replacement devices is indicated.

U.S. Pat. No. 4,301,738, dated Nov. 24, 1981, discloses an apparatus for the replacement of track rails, which comprises two successive work vehicles with projecting, cantilevered machine frame portions. The leading work vehicle carries longitudinally displaceable tools for pulling spikes and devices for lifting and spreading the rails as well as a vertically adjustable receptacle, including a magnetic drum, for the pulled spikes. The trailing work vehicle carries a crib broom, a device for placing and inserting tie plates and a tool for driving the spikes into the ties. The machine has no means for replacing some or all of the ties.

German Pat. No. 2,230,202, of Aug. 16, 1973, discloses a device for clearing ballast from a track bed. This ballast removing device or scarifier comprises plate-shaped ballast clearing and planing tools which are vertically and laterally adjustably mounted on a cantilevered front portion of the machine frame. The ballast removing plates are preceded by a longitudinally displaceable push rod which may be driven to push a respective tie whose fastening elements have been slightly loosened to enable the ballast removing plates to push the ballast under the displaced tie towards the track shoulder.

It is also known, and has been widely practiced, to exchange only groups of ties in an existing track, for example every third or fourth tie or groups of adjacent ties between ties retained in the track to enable the same to support rolling stock traveling thereover, which is the technology to which the present invention relates. Such a partial tie exchange or renewal is repeated every few years until all the ties of the track has been replaced. Such a mechanized tie gang has been described on pages 22 to 24 of "Railway Track and Structures", Nov. 1983. This mechanized tie gang comprises up to 24 pieces of equipment, such as tie cranes, spike pullers, tie shears, tie cranes for handling tie butts, rotary scarifiers, tie injectors, tampers, rail lifts, spikers and ballast regulators. In the operation of this tie gang, the old ties are withdrawn and placed on the shoulders of the track after optionally being sawn into chunks and they are then loaded onto railroad cars. The new ties are placed on the track shoulders for insertion. The loading and unloading of the ties may be effected at a different time than the tie exchange operation.

The mobile tie exchange apparatus comprises a succession of coordinated and different individual devices operative to effectuate different sequential operations for exchanging the selected ties, such as tie exchange operating devices equipped for pulling spikes, removing old tie plates, withdrawing old ties, scarifying the ballast, inserting new ties, placing new tie plates and driving new spikes. These tie exchange operating devices are suitably spaced from each other in the direction of the railroad track for coordinated operation. Some of such devices are shown in the September 1985 issue of "Railway Track and Structures", including the tie remover/inserter described and illustrated on pages 49 and 64, the self-propelled tie saw on page 58, the spike puller and hydraulic track lifter on page 61, the mechanized plate handling machine on page 66, the anchor tightening machine on page 105, and the spike setter-driver on page 106. Each of these machines are individually operated, self-propelled devices having their own undercarriages for supporting them on the railroad track.

In addition to the above-mentioned mechanized tie gang, other tie-renewal gangs are described on pages 28, 29 and 31 of "Railway Track and Structures", June 1978, and on pages 14 to 16 of the December 1968 issue of this publication. All of these known mechanized tie gangs are comprised of varying numbers of some 14 to 24 individual self-propelled machines, operating personnel being stationed between some of these machines for effectuating additionally required operating steps. The exchange of every third or fourth tie is effected with these known mechanized tie gangs by first removing the tie clips or anchors from the track, then pulling the spikes, removing the old tie plates, withdrawing every third or fourth tie, optionally sawing the withdrawn tie into chunks, placing the withdrawn ties or tie chunks on the track shoulder, scarifying the ballast, i.e. excavating it, in the areas of the track bed which supported the withdrawn ties, inserting new ties in these scarified track bed areas, the new ties having been conveyed to, or stored on, the track shoulder laterally adjacent these areas, whereupon new tie plates are inserted between the inserted new ties and the slightly raised railroad track rails, the new ties are tamped, new spikes are driven into the new ties to fasten the rails thereto, and the tie clips or anchors are applied again. In this connection, an independently operating tie plate distributor car, such as described and illustrated on pages 93 and 94 of "Progressive Railroading", March 1984, may be used for transporting and storing the old and new tie plates.

A tie renewal operation with the individual machines hereinabove described does not only require a large number of operators, including control and monitoring personnel, but also blocks long track sections and their neighboring tracks for a long time so that train traffic is interrupted for extended periods. The efficiency is low because it is exceedingly difficult to coordinate the operation of the many individual machines which are spaced from each other along the railroad track, causing numerous interruptions in the operation. In addition, if an attempt is made to pass some trains on a neighboring track even at low speed, the operators are exposed to danger. The mechanized tie gangs of the prior art, as exemplified hereinabove, does not produce accurate work since it is often difficult, if not impossible, properly to coordinate the operation of the individual machines and to align them exactly with the track line and level for their designated work.

Commonly assigned U.S. applications Ser. Nos. 97,757, 97,759 and 97,760, all filed Sept. 17, 1987, disclose a mobile tie replacement apparatus which comprises at least one elongated bridge-like work vehicle having two undercarriages supporting respective opposite ends of the work vehicle on the railroad track, and a succession of different individual devices mounted on the work vehicle or vehicles between the undercarriages and operative to effectuate different sequential operations for exchanging the selected old ties for the new ties.

U.S. Pat. Nos. 4,175,902, dated Nov. 27, 1979, and 4,190,394, dated Feb. 26, 1980, disclose an apparatus and method for loading and unloading open top or gondola railroad cars for transport of the ties used in such a tie exchange operation. The apparatus comprises a train mounted for mobility along the railroad track and includes a plurality of the open top railroad cars having a considerable loading volume, adjacent ones of the railroad cars being coupled together and each railroad car having two high parallel side walls with top edges and two high end walls, the end walls of the adjacent railroad cars defining respective gaps therebetween, and a power-driven crane with booms for loading and unloading the ties and having two undercarriages supporting the crane for mobility in the direction of the railroad track. The undercarriages have pneumatic tires to enable the crane to be moved along a road or the railroad track, and the crane also has pivoted gliding feet or brackets for gripping the top edges, the relatively widely spaced top edges of the railroad cars serving as a track for moving the crane along the cars while the gliding feet grip the top edges. A cable is attached to the crane to pull the crane along the railroad cars as it is perched atop the cars. Operation of this apparatus requires great skill and a number of sometimes life-threatening manual steps. The movement of the crane between adjacent cars is particularly difficult and very time-consuming, which considerably reduces the efficiency of the operation. The crane movement along and between the cars is quite unstable, providing unsafe operating conditions and frequent interruptions. In addition, the tractor used for the crane must be specially designed to enable the crane to effectuate the required forward and rearward movements on the top edges of the gondola cars.

The old and new ties may be loaded, transported and unloaded at the same time or another time by a mobile loader and unloader installation of the first-described type. After the tie exchange has been completed, the ballast supporting the track may be regulated and shaped, and the track ties may be tamped, with a concomitant track correction, for example by means of a track tamping, leveling and lining machine of the type disclosed in U.S. Pat. No. 4,534,295, dated Aug. 13, 1985.

SUMMARY OF THE INVENTION

It is the primary object of the present invention to improve apparatus for sequentially exchanging selected consecutive groups of old ties, such as three ties at a time, for groups of new ties while retaining groups of old ties between the selected old ties for support of the mobile apparatus on the railroad track so that the tie exchange may be effected economically while the apparatus continuously advances along the railroad track and the ties are efficiently transported in a simple manner.

The above and other objects are accomplished in accordance with this invention with a mobile apparatus which comprises at least one bridge-like work vehicle having a machine frame defining an upwardly recessed portion between respective ends thereof, a respective swivel truck supporting each machine frame end, and drive means for the continuous advancement of the work vehicle on the railroad track in an operating direction, the drive means being a drive mounted on the work vehicle whereby the work vehicle is self-propelled or a driven tie transport car whereto the work vehicle is coupled. A continuous guide track is mounted atop the work vehicle and a power-driven crane is mounted for mobility on the guide track and includes means for receiving ties for transport by the crane. A succession of different individual devices are mounted in the recessed portion of the work vehicle machine frame and operative to effectuate different sequential operations for exchanging the selected old ties for the new ties, the tie exchanging devices including in sequence in the operating direction (1) a spike pulling device, (2) a spike collecting device for collecting the pulled spikes, (3) a ballast clearing device including tools for lifting the railroad track lifting and for laterally moving the old ties wherefrom the spikes have been pulled, (4) a tie plate transporting device, (5) a tie pulling device for laterally withdrawing the laterally moved old ties from the railroad track and a vertical conveyor succeeding the tie pulling device for conveying the withdrawn old ties, (6) a tie inserting device for inserting the new ties and a vertical conveyor preceding the tie inserting device for conveying the new ties thereto, another ballast clearing device being preferably arranged between the tie pulling and tie inserting devices, and (7) a device for tamping ballast under the inserted new ties, which preferably includes a rotary ballast broom. Each tie exchanging device is connected to a respective drive for displacing the device with respect to the work vehicle machine frame along a displacement path extending in the direction of the longitudinal extension of the work vehicle machine frame.

This surprisingly simple, yet advantageous arrangement of the tie pulling and inserting devices associated with a vertical tie conveyor on a single, common, continuously advancing apparatus make a most rational tie exchange operation possible since the old ties may be placed directly on the track after they have been withdrawn and may then be received by the succeeding vertical tie conveyor for conveyance to the top of the work vehicle where they can be transported by the power-driven crane and, reversely, the power-driven crane may transport the new ties to the vertical tie conveyor preceding the tie inserting device where the new ties are inserted in the previously cleared ballast area. The high efficiency of the tie transport is assured by mounting the transport crane atop the open top tie transport cars and work vehicles so that the tie transport and the tie exchange operations do not interfere with each other. If the crane is capable of transporting whole stacks of ties, the transportation capacity is further enhanced.

The ready transportation of the ties combined with the sequential mounting of the required tie exchanging devices on one or more continuously advancing work vehicles enables all the operations to be effectively organized and controlled so that the effectiveness of each operation can be maximized. Since each individual tie exchanging device is longitudinally displaceable and has its own displacement drive, the work vehicles may advance non-stop while operators of these devices control the displacement thereof relative to the work vehicle in a direction opposite to the operating direction so that the devices will be held stationary relative to the railroad track for the relatively brief intervals during which they are in operation. In this manner, the entire mobile apparatus will continuously advance during the tie exchange operation while the individual operations are effectuated efficiently and without interference.

The above and other objects, advantages and features of this invention will become more apparent from the following detailed description of certain now preferred embodiments thereof, taken in conjunction with the accompanying somewhat schematic drawing.

DESCRIPTION OF THE PREFERRED EMBODIMENTS

Figures 1, 2, 3, 4:
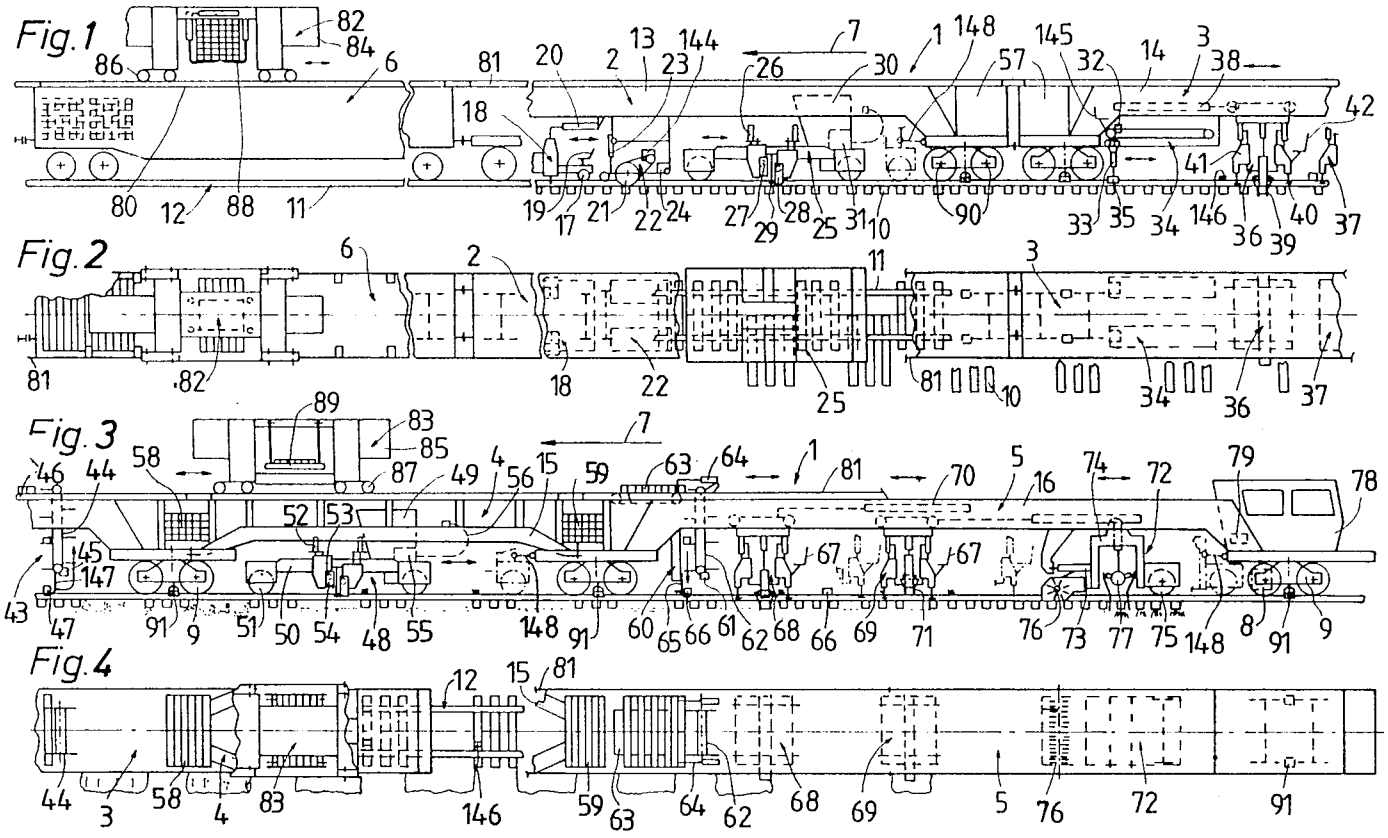
FIG. 1 is a side elevational view of the forward portion of a mobile apparatus according to the invention.
FIG. 2 is a top view of FIG. 1.
FIG. 3 is a side elevational view of the rear portion of the apparatus of this embodiment.
FIG. 4 is a top view of FIG. 3.

Referring now to the drawing and first to FIGS. 1 to 4, there is shown mobile apparatus 1 for sequentially exchanging selected consecutive groups of old ties in existing railroad track 12 consisting of rails 11 fastened to ties 10 for groups of new ties while retaining groups of old ties therebetween to support the mobile apparatus on the track. The illustrated mobile apparatus comprises a succession of work vehicles coupled together, including first, second, third and fourth work vehicles 2, 3, 4 and 5, the coupled together work vehicles forming a train with preceding tie transport car 6 in a manner similar to that disclosed in the above-identified copending patent applications. Each bridge-like work vehicle has a respective machine frame 13, 14, 15 and 16 defining an upwardly recessed portion between respective ends thereof.

Swivel trucks 9 support the work vehicle frame ends on railroad track 12 and drive 9 (at the right of FIG. 3) is designed for the continuous advancement of the work vehicles in an operating direction indicated by arrow 7. The drive may also be provided by a locomotive or a self-propelled freight car 6 to which the work vehicles are coupled. Preferably, the swivel trucks have two axles 90 spaced from each other in the operating direction by a distance corresponding to at least three crib widths. Track gage retaining means 91 is arranged between the swivel truck axles and includes guide elements engaging rails 12 of railroad track 12. The use of swivel trucks reduces the pressure of the work vehicles on the railroad track from which some of the supporting ties have been withdrawn and the two-axled swivel trucks have the advantage that one of the axles will still run on a track section supported on a tie while the other axle is aligned with an adjacent track section with has no ties.

A succession of different individual devices are mounted in the recessed portions of the work vehicle frames and are operative to effectuate different sequential operations for exchanging selected old ties 47 for the new ties, the tie exchanging devices including in sequence in the operating direction spike pulling device 18, spike collecting device 22 for collecting the pulled spikes, ballast scarifying or clearing device 25, tie plate transporting device 34, tie pulling devices 36, 37, tie inserting devices 68, 69 and ballast tamping device 72. Respective drives displace the tie exchanging devices with respect to the machine frames of work vehicles 3 and 5 along a displacement path in the direction of the longitudinal extension of the work vehicle frame. Arranging the tie exchanging devices sequentially on successive work vehicles supported on swivel trucks has the advantage that the individual devices will be centered automatically even in sharp track curves and, at the same time, these devices will be sufficiently spaced from each other so that they will not interfere with each other during their respective operations.

The first work vehicle carries track-bound spike puller 18 longitudinally displaceably mounted in recessed frame portion of machine frame 13 of first work vehicle 2, the spike puller having flanged wheels 17 for rolling support on rails 11 of railroad track 12, track-bound spike collecting device 22 comprising magnetic drum 21 arranged to receive spikes pulled by the spike puller, and track-bound self-propelled ballast clearing device 25. The spike puller has an operator's seat 19 for an operator controlling the spike pulling operation. Longitudinal displacement drive 20 connects spike puller 6 to machine frame 13 of work vehicle 2 for displacement in the upwardly recessed frame portion of the work vehicle above track 12. Magnetic drum 21 of spike collecting device 22 is rotatable counterclockwise and precedes a spike collecting repeatable 24 for storing the spikes moved thereto by rotating drum 21. A vertical displacement drive 23 is connected to the magnetic drum for lifting the same off the track when apparatus 1 is moved between operating sites.

Ballast clearing device 25 comprises a track-bound frame propelled by its own drive 31 and carrying operator's cab 30 for an operator of the device. Power-driven longitudinally, transversely and vertically adjustable ballast clearing tools 28 and vertically adjustable track lifting means 29 are mounted on the self-propelled frame of the ballast clearing device. This arrangement enables the ballast wherein the old tie is embedded to be readily cleared away so that the withdrawl of the tie is facilitated and the efficiency of the tie exchange operation during the continuous advance of apparatus 1 is enhanced.

Tie plate transporting device 34 mounted in the upwardly recessed portion of machine frame 14 of second work vehicle 3 comprises magnet 35 for holding the tie plates and is connected to longitudinal displacement and lifting drives 32, 33. It is followed immediately by two sequentially arranged tie pulling devices 36, 37 which are sufficiently spaced from each other to permit their longitudinal displacement for operation of the devices without interference to withdraw groups of old ties from the railroad track. Each tie pulling device is longitudinally displaceably suspended from machine frame 14 on flanged rollers supported in guides on the machine frame and is connected to a respective longitudinal displacing drive 38. Each tie pulling device comprises a power-driven tie clamp 39 and a pair of lifting plates 40 wherebetween the tie clamp is arranged for subtending the heads of rails 11. The tie clamp and rail lifting plates are connected to carrier frame 41 equipped with operator's seat 42 for an operator of the device. Vertical tie conveyor 43 (see left end of FIG. 3) succeeds tie pulling devices 36, 37 for conveying the withdrawn old ties. The vertical conveyor comprises endless conveyor chain 44 actuated by drive 45 and connected to machine frame 14. As shown in the drawing, withdrawn old ties 47 are placed on railroad track 12 where they are picked up by conveyor chain 44 and vertically moved up to storage place 46 atop the work vehicle.

Figure 5:
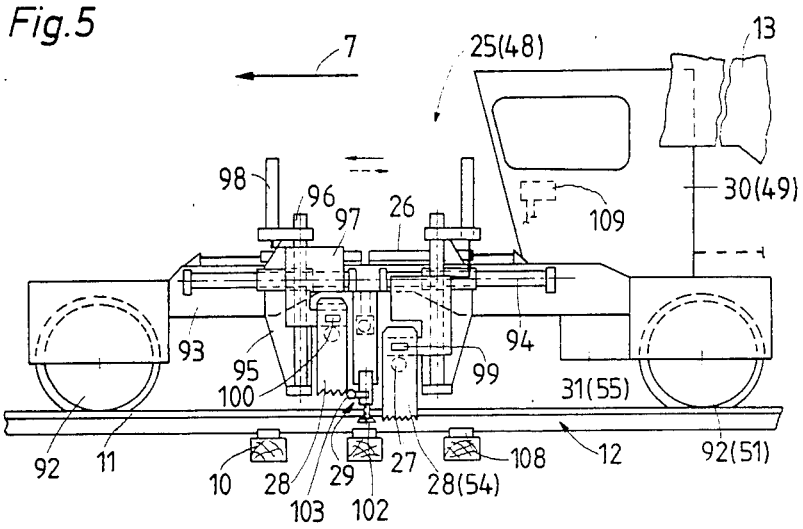
FIG. 5 is an enlarged side elevational view of a ballast clearing and planing device used in the mobile apparatus of FIG. 1.
Figure 6:
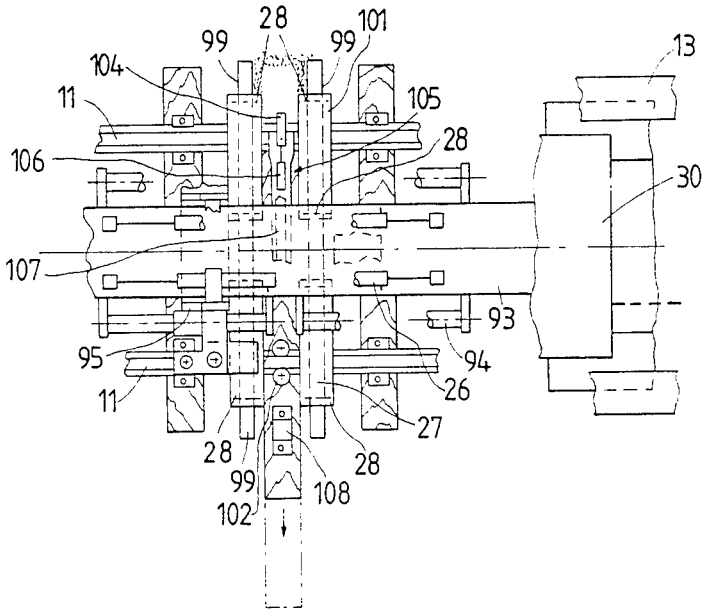
FIG. 6 is a top view of FIG. 5.

As shown in the drawing, another ballast clearing and planing device 48 of a structure similar to that of device 25 is arranged in the upwardly recessed portion of machine frame 15 of third work vehicle 4. Track-bound frame 50 running on undercarriages 51 has an operator's cab 49 and drives 52, 53 operate the longitudinally, transversely and verticallay adjustable ballast bearing tools 54 serving tp clear and plane ballast serving to support the new ties 66 and filling cribs therebetween. Drive 55, which propels frame 50 along the track, as well as drives 52, 53 are connected by flexible hydraulic line 56 to central power plant 57 of apparatus 1. If desired, however, drive 55 may be an independently operable internal combustion engine or other suitable drive means. Respective storage space for stack 58, 59 of the old and new ties are arranged above rear swivel truck 9 of the second and the front swivel truck of the fourth work vehicles. FIGS. 5 and 6 illustrate the structure of the ballast clearing devices in detail.

Vertical tie conveyor 60 comprising endless conveyor chain 62 driven by drive 61 precedes a pair of successive tie inserting devices 68, 69 in the upwardly recessed portion of machine frame 16 of fourth work vehicle 5. A storage place constituted by endless conveyor band 63 for new ties 66 is arranged atop the work vehicle between stack 59 of new ties and vertical tie conveyor 60 and gripping device 64 is longitudinal displaceable for gripping respective new ties stored in a row on conveyor band 63 and moving them to the vertical tie conveyor. Vertically adjustable tie supporting hook 65 is arranged at the underside of vertical tie conveyor 60 for receiving new ties 66 from conveyor chain 62, which conveys the new ties downwardly towards railroad track 12, and placing the new ties on the railroad track by lowering the hook to the track. Suitably spaced tie inserting devices 68, 69 of a similar structure as devices 36, 37 follow the vertical tie conveyor in the operating direction and a respective longitudinal displacing drive 70 connects each device 36, 37 to machine frame 16. Each tie inserting device has tie clamp 71.

Finally, ballast tamping device 72 is connected to machine frame 16 of fourth work vehicle 5 by longitudinal displacing drive 73. The ballast tamping device will be described in more detail in connection with FIGS. 9 and 10, and comprises track-bound carrier frame 74 including a centrally projecting pole connected to the displacing drive, and a respective vertically adjustable tamping tool assembly 77 associated with each rail 11 for independent operation, each assembly including pairs of reciprocatory and vibratory tamping tools. Rotary ballast broom 76 precedes the tamping tool assemblies in the operating direction. The machine frame of fourth work vehicle 5 carries driver's cab 78 immediately behind the ballast tamping device, and this cab houses a central drive control 79 for the apparatus as well as a control for operation of the ballast tamping device.

This illustrated arrangement of a tie exchange train enables a number of individual tie exchanging devices to be operated substantially simultaneously at different track sections as the train advances non-stop so that the tie exchange proceeds in an assembly-line fashion with high efficiency and trouble-free while, at the same time, enabling the old and new ties to be transported rapidly without interfering with the tie exchange. The productivity is further enhanced by the tandem arrangement of the tie withdrawing and inserting devices. Since each device is independently longitudinally displaceable, its operator may position it independently and accurately within the free space provided within the upwardly recessed machine frame portion to conform to the prevailing operating conditions. If desired, additional such devices may be provided to enhance the productivity of the apparatus further. If desired, commercially available individual tie exchanging devices may be used in mobile apparatus 1, the only requirement being that they are connected to the respective machine frame by a longitudinal displacing device.

As shown in FIGS. 1 and 3, continuous guide track 81 is mounted atop work vehicles 2 to 5 and extends over top edges 80 of the two parallel side walls of open-top freight car 6 for loading the ties. Power-driven gantry cranes 82, 83, each equipped with its own drive 84, 85 and double-flanged wheels 86, 87 running on the continuous guide track, are mounted for mobility on the guide track and each crane includes means for receiving ties for transport by the crane. The tie receiving means of power-driven front crane 82 is constituted by four vertically adjustable tie gripper arms 88 rotatable about a vertical axis for cooperatively subtending and thereby supporting a stack 58 or 59 of old or new ties for lifting or lowering and transporting the stack. Such tie receiving means enables a stack of, for example 42, ties to be transported by the crane, thus reducing the number of transports and considerably increasing the productivity. Since the tie gripper arms are rotatable, stacks of ties may readily be lifted out of the open-top freight car by rotating the gripper arms to extend transversely to the track so that they may be lowered into a gap defined between two stacks of ties for gripping a stack. The tie receiving means of power-driven rear gantry crane 83 comprises L-shaped tie retaining ledges 89 spaced apart a tie length from each other for cooperatively supporting a row of, for example 6, adjacent ties, the retaining ledges being pivotal for releasing the row of ties. This arrangement enables crane 83 to move a reduced number of new ties 66 a short distance from a storage place holding a stack 59 of ties to a smaller temporary storage station 63 whence they may be readily conveyed to the track ready for insertion.

FIGS. 5 and 6 illustrate ballast clearing device 25 (48) which comprises track-bound frame 93 supported on undercarriages 92 (51) running on railroad track 12. Two power-driven, transversely, longitudinally and vertically adjustable ballast clearing tools 28 (54) are mounted on the frame. Horizontal guides 94 extending in the operating direction are affixed to frame 93 and respective tool carriers 95 for the ballast clearing tools are slidably mounted on the horizontal guides and are connected to longitudinal displacing drives 26 for longitudinal adjustment of the tool carriers in the operating direction. At each longitudinal side of the carrier, each tool carrier is connected to a vertical guide 96 vertically slidably supporting a guide block 97, respective drives 98 enabling the tool carriers to be vertically adjusted. Transversely aligned guide blocks 97 of the tool carriers are interconnected by respective transverse guide rod 99. Pairs of ballast clearing tools 28 (54) interconnected by respective connecting plate 101 (see FIG. 6) are displaceably mounted on guide rods 99, the ballast clearing tools having guide apertures 100 corresponding in cross section to the cross section of the guide rods and receiving the guide rods. Transverse adjustment drive 27 is a cylinder-piston drive whose cylinder is affixed to guide rod 99 intermediate the ends thereof while a respective piston rod is affixed to a respective one of the ballast clearing tools of each pair.

Railroad track lifting means 29 is mounted on frame 93 centrally between ballast clearing tools 28 (54) and comprises lifting plates 102 arranged to be pivoted by drive 103 to subtend the heads of rails 11. Furthermore, means 105 for laterally moving the old ties wherefrom the spikes have been pulled are also mounted centrally between the ballast clearing tools, which means comprises transversely displaceable hook 104 arranged for engagement with an end of a respective old tie for pushing the tie (see FIG. 6). Hook 104 is pivotal by drive 106 about an axis extending in the operating direction. Lateral tie moving means 105 is teslecopingly displaceable transversely by drive 107 to push the old tie partially out of the railroad track into a position shown in chain-dotted lines in FIG. 6. This enables the tie to be pushed out at least about a third of its length, for example, which further enhances the productivity of the apparatus because it produces a two-stage tie withdrawal at sequentially arranged tie exchanging devices, i.e. first at the ballast clearing device and then at the tie pulling device proper.

The clearing of the ballast to the track shoulder may be effected during the continuous advancement of apparatus 1 in the operating direction indicated by arrow 7 in the following manner: Lifting plates 102 are pivoted into engagement with rails 11 to lift railroad track 12 slightly off the ballast bed and ballast clearing tools 28 (54) are lowered into engagement with the ballast in the cribs adjacent the old tie to be withdrawn by actuating drives 98. Transverse adjustment drives 27 are then actuated to move ballast clearing tools 28 (54) to their outermost lateral positions whereby the ballast engaged by the tools is moved from the cribs to the track shoulder. Subsequently, the ballast clearing tools are disengaged from the ballast by actuation of drives 98 and, if desired, this ballast clearing operation is repeated to clear more ballast from the cribs while longitudinal displacing drives 26 are actuated as required by the continuous advance of the apparatus. As soon as the ballast in the cribs has been cleared, drive 106 is actuated to engage hook 104 with the end of the tie between the cleared cribs and drive 107 is then actuated to push the tie out of track 12 by about a third to a half of its length. An operator's cab 30 (49) is mounted on frame 93 within view of the ballast clearing device and central control panel 109 in the cab enables an operator to control the actuation of the various operating drives.

Ballast clearing device 48 on third work vehicle 4 is of substantially the same structure as ballast clearing device 25, except for the omission of the track lifting means between the ballast clearing tools.

Figure 7:
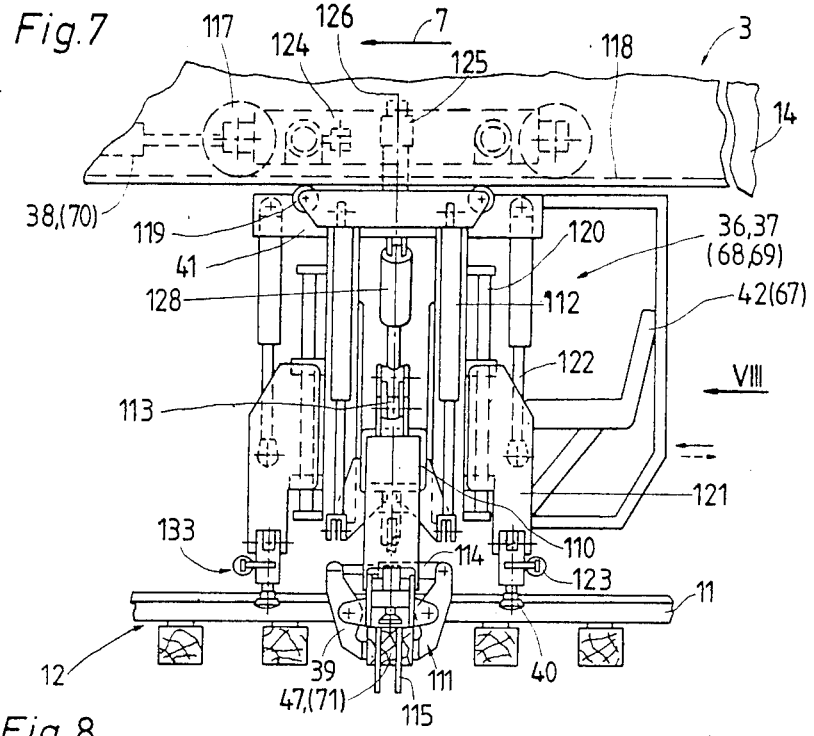
FIG. 7 is an enlarged side elevational view of the tie pulling and withdrawing devices used in the mobile apparatus.
Figure 8:
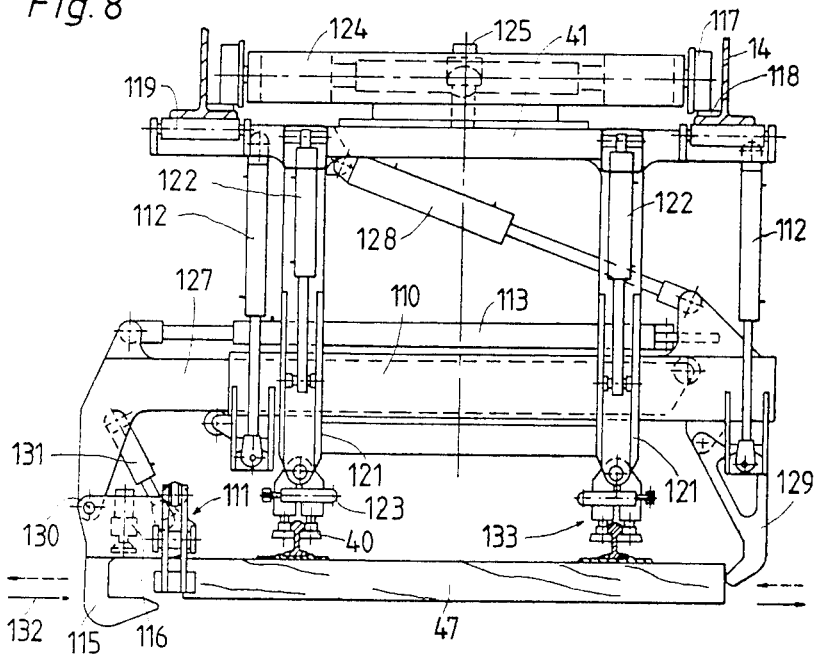
FIG. 8 is an end view of a the device of FIG. 7, seen in the direction of arrow VIII.

A specific embodiment of the tie pulling and inserting devices 36, 37 and 68, 69 is illustrated in FIGS. 7 and 8. Each such device comprises carrier frame 41 longitudinally displaceably mounted in the recessed portion of machine frame 14 (and 16), and gripping means 111 for gripping an end of a respective old tie 47 or new tie 71, the tie end gripping means including a tie clamp pincers 39 and drive 114 for operating the tie clamp pincers. Transversely extending guide element 110 telescopingly and displaceably receives the tie end gripping means, vertical adjustment drives 112 connect the guide element to the carrier frame and transverse adjustment drive 113 connects tie end gripping means 111 to guide element 110 whereby the tie end gripping means is vertically and transversely adjustable. Hook 115 is arranged below tie clamp 39 and has a tie end lifting part projecting towards the tie clamp to subtend the gripped tie end. Ram 116 arranged to press the end of the gripped tie against subtending hook 115 is arranged between hook 115 and tie clamp pincers 39. To prevent tilting of the device during the tie pulling or inserting operation, the carrier frame is equipped with rollers 119 engaging an underside of the machine frame (see FIG. 8).

Furthermore, each tie pulling and inserting device comprises two rail lifting devices 133, tie gripping means 111 being arranged between the two rail lifting devices. The rail lifting devices comprise vertical guides 120 affixed to carrier frame 41 and respective tool carrier 121 slidably mounted on each vertical guide 120, drives 122 being connected to the tool carriers for vertical adjustment thereof. Pairs of lifting plates 40 are mounted at the lower ends of tool carriers 121 and are pivotal by drives 123 into engagement with rails 11 to subtend the rail heads. Carrier frame 41 with all the drives carried thereby is mounted on support carrier 124 for rotation through at least 180° about vertical axis 126 by rotating drive 125 to enable the device to be used selectively at one or the other rail of track 12. Support carrier 124 runs on flanged rollers 117 on longitudinal guides 118 of the machine frame.

As will be seen in FIG. 8, tie gripping means 111 is mounted on guide beam 127 transversely displaceably and telescopingly mounted in guide element 110. The tie gripping means is pivotal by drive 131 about axis 130 extending in the operating direction. The guide element is connected to transverse adjustment drive 128 which enables tie gripping means 111 with guide element 110 suspended on carrier frame 41 by vertical adjustment drives 112 at opposite ends thereof to be transversely adjusted. Hook 129 is mounted on an end of guide element 110 at a side of carrier frame 41 transversely opposite tie end gripping means 111 for pressing against an end of tie 47 opposite the gripped tie end. The hook transmits a pushing force against the tie in the direction of the gripped tie end.

Such a tie pulling and inserting device is able rapidly to grip and laterally to displace a tie while the longitudinal displacing drive holds it in place during the continuous advance of apparatus 1. The tie end gripping means is simply arranged and may be readily controlled from the operator's seat on the device. Hook 115 with its projecting lifting part further improves the lateral displacement of the tie while track 12 is slightly lifted off the ballast bed, thus making tie exchange operations in encrusted ballast easier. The projecting hook part may be used for the brief lifting of the track to facilitate the removal of the tie from the encrusted ballast. The arrangement of the pairs of lifting plates engaging each rail 11 and tie engaging hook 129 enables the tie displacement operation to proceed simply and rapidly while the track is raised. and tie end engaging hook 129 will help to overcome the initial resistance encountered during withdrawal of the tie, preventing at the same time tie gripping means 111 from slipping off the opposite tie end. This arrangement may be readily retrofitted on existing tie pulling and inserting devices.

At the beginning of the tie pulling or withdrawing operation during the continuous advancement of apparatus 1, the operator on operator's seat 42 (67) within view of the tie pulling or withdrawing device actuates longitudinal displacing device 38 (70) connected to support carrier 124 until carrier frame 41 with tie end gripping means 111 is in vertical alignment with the tie to be pulled or inserted. Drives 122 are then actuated to lower tool carriers 121 until lifting plates 40 are in a position for engaging the rail heads upon pivoting by drives 123. Drives 122 are then actuated for slightly lifting railroad track 12 off the ballast bed. Drives 112 are then actuated to lower guide element 110 with tie end gripping means 111 into a position wherein tie clamp 39 can grip the end of the tie by actuation of drive 114. Particularly in the case of heavily encrusted ballast embedding the ties, the tie may be loosened by engaging hook 115 with the underside of old tie 47 and pivoting the tie end gripping means by actuating drive 131. A brief actuation of transverse adjustment drive 128 enables guide element 110 to be slightly adjusted transversely until tie pushing hook 129 engages the opposite end of the tie. The device is now in position for the actual tie withdrawing operation, which is initiated by actuation of transverse adjusting drive 113. This causes transverse displacement of guide beam 127 with tie end gripping means 111 to move the tie laterally in the direction of arrow 132. At the beginning of the tie pulling operation, drive 128 may be actuated to cause hook 129 to push the tie in the withdrawal direction, which will be particularly helpful in an encrusted ballast bed. After the tie has been fully withdrawn, vertical drives 112 are actuated to lift the gripped tie held by tie end gripping means 111 and hook 129 above the rail level, whereupon drive 113 is actuated in the reverse direction to place the tie on rails 11. Rail lifting devices 133 are then released from rails 11 and tie clamp 39 is released from the tie end, whereupon longitudinal displacing drive 38 (70) is actuated to reposition the device into its foremost position with respect to the machine frame. The device is now in position for the next tie pulling or inserting operation.

Tie pulling devices 36, 37 and tie inserting devices 68, 69 have substantially the same structure, the tie insertion operation proceeding substantially in reverse to the tie pulling operation. In other words, new ties 66 are picked up from the track on which they are placed, their ends are gripped by gripping means 111 and the ties are inserted.

Figure 9:
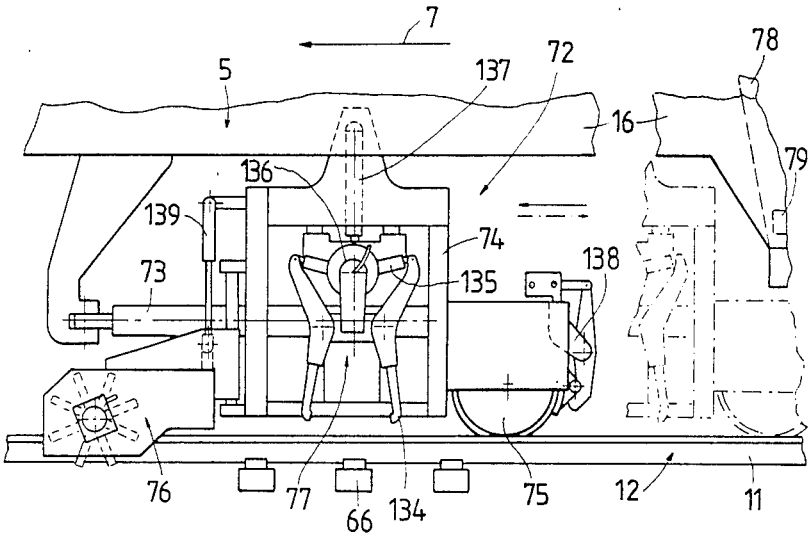
FIG. 9 is an enlarged side elevational view of the ballast tamping device used in the mobile apparatus.
Figure 10:
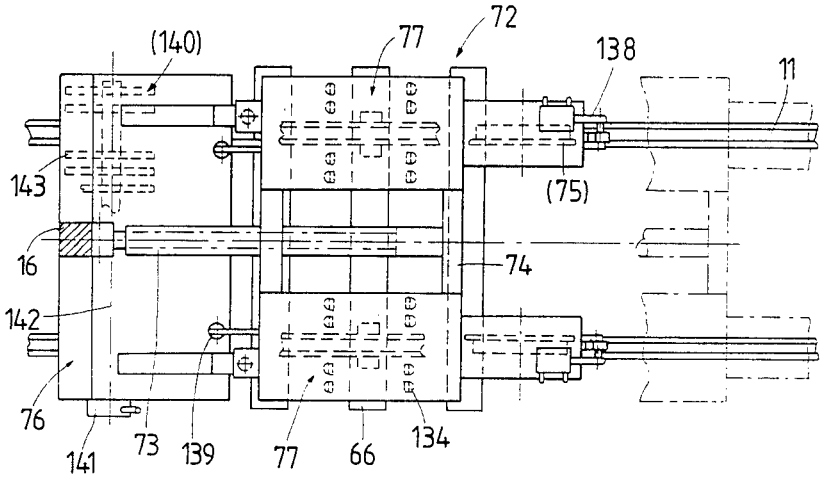
FIG. 10 is a top view of FIG. 9.

Ballast tamping device 72 is illustrated in detail in FIGS. 9 and 10. It comprises track-bound carrier frame 74 including a centrally projecting pole connected to longitudinal displacing drive 73, respective tamping tool assembly 77 associated with each rail 11, each assembly including pairs of reciprocatory and vibratory tamping tools 134, rotary ballast broom device 76 preceding tamping tool assemblies 77 in the operating direction indicated by arrow 7, drive 141 for rotating ballast broom 140 about a transversely extending axis, and drive 139 for vertically adjusting the ballast broom device with respect to carrier frame 74. Undercarriage 75 having flanged wheels engaging rails 11 supports a trailing end, in the operating direction, of carrier frame 74 on railroad track 12, and longitudinal displacing drive 73 connects a front end of the pole of the carrier frame to the upwardly recessed portion of machine frame 16 of fourth work vehicle 5. The combination of tamping tool assemblies with a preceding rotary ballast broom produces an efficient operating unit enabling any ballast on the ties to be brushed off before the ties are tamped. The ballast is moved by the broom into the adjacent crib so that there is sufficient ballast available for the subsequent ballast tamping and, additionally, the track is clean and ready for traffic immediately behind the tie exchange apparatus. The carrier frame with the pole makes the longitudinal displacement of the ballast tamping device with respect to the machine frame particularly simple. The support of the carrier frame on the track solely by rear wheels automatically assures centering of the tamping tool assemblies over the associated rails in track curves. Since the newly inserted ties are tamped, they securely support the rails at the desired level immediately after their insertion.

Tamping tools 134 of tamping tool assemblies 77 are reciprocated by drives 135 and vibrated by drive 136. The tamping tool assemblies are vertically adjustable om carrier frame 74 by vertical adjustment drives 137 linking the assemblies to the carrier frame to enable the tamping tools to be immersed in the ballast for tamping the ballast under new ties 66. Braking device 138 is associated with undercarriage wheels 75 for braking the ballast tamping device independently.

As shown in FIG. 10, rotary ballast broom device 76 includes transversely extending ballast broom 140 rotatable by drive 141 about axis 142. The broom has hose-shaped elements 143 extending radially about axis 142 for clearing ballast off the ties and rails.

Ballast tamping device 72 enables newly inserted ties 66 to be tamped while work vehicle 5 continuously advances in the operating direction by lowering tamping tool assemblies 77 and tamping ballast under the intersections of the ties and rails by reciprocating and vibrating the tamping tools. For this purpose, the ballast tamping device is longitudinally displaced by drive 73 into its foremost position shown in full lines in the drawing and is temporarily held in a centered position over new ties 66 while the tie is tamped. At the same time, drive 139 is actuated to lower ballast broom 140 to the level of the ties and drive 141 is actuated to rotate the broom whereby ballast is brushed off the ties into the cribs before the ties are tamped. Meanwhile, work vehicle 5 has advanced so that the ballast tamping device is in the rearmost position relative to machine frame 16, as shown in chain-dotted lines. The tamping tool assemblies and, if desired, the rotary broom assembly are now raised and the ballast tamping device is again displaced into its foremost position to be ready for the next tamping operation.

If desired, fourth work vehicle 5 may be followed by a further work vehicle with devices for inserting tie plates and driving spikes to fasten the newly inserted ties to the rails. On the other hand, these operations may be effected by individual mobile devices following apparatus 1 or by hand.

Mobile tie exchange apparatus 1 illustrated in FIGS. 1 to 4 operates in the following manner:

Drive 8 is operated to advance train 1 to the operating site, open-top freight car 6 being loaded with new ties (in a manner more fully disclosed and claimed in the above-identified, previously filed patent applications). When the operating site has been reached, operators are placed in the various operator's accommodations on work vehicles 2 to 5 for operation of the individual tie exchange devices while the train is advanced non-stop by drive 8 in an operating direction indicated by arrow 7. The operator on operator's seat 19 on spike puller 18 at each track rail 11 operates the spike pulling tools at the left and right of each rail to pull the spikes out of those old ties 47 which are to be exchanged. While the spikes are pulled, drive 20 holds spike puller 18 stationary with respect to track 12. After all the spikes are pulled, longitudinal displacement drive 20 is operated to displace the spike puller to its forward end position with respect to frame 13 of work vehicle 2. In this end position, the spikes are pulled from a succeeding group of old ties. The pulled spikes are collected by operating drive 144 to rotate magnetic drum 21 and transport the magnetically held spikes to storage container 24.

Meanwhile, the operator in cab 30 on first work vehicle 2 operates the vertically adjustable ballast scarifier tools 28 of ballast clearing and planing device 25 to move the ballast away from the end of a respective old tie 47, or group of old ties. This facilitates the operation of tie pushing device 105 (FIG. 6) to withdraw the tie, from which the spikes were previously pulled, laterally a distance of about one third to one half of the tie length. This partial tie withdrawal operation begins while the ballast clearing and planing device is in its foreward end position where it is held stationary during the operation with respect to the track. Since train 1 continuously advances, however, ballast clearing and planing device 25 is continuously displaced rearwardly with respect to the work vehicle into the rear end position indicated in FIG. 1 in dash-dotted lines. In this end position, the ballast clearing and partial tie withdrawal operations have been completed. Drive 31 is now operated for the rapid forward displacement of ballast clearing and planing device 25 into the forward end position to be ready for the succeeding ballast clearing and partial tie withdrawal operation. To facilitate the partial withdrawal of the tie, the track rail in the range of the tie to be withdrawn is momentarily lifted by lifting device 29.

At the front end of succeeding work vehicle 3, partially withdrawn old ties 47 are sensed by tie plate transport device 34 whose magnet 35 picks up the tie plates loosely lying on these ties. The operator on seat 145 affixed to machine frame 14 operates tie plate transport device 34 or, if desired, this operation may be controlled by an operator walking along the track. The tie plates are placed on stack 146 on one of ties 10 retained in railroad track 12. Tie pulling devices 36, 37 are controlled by an operator on seat 42 mounted on these devices. While apparatus 1 continuously advances, the end of each one of the three partially withdrawn old ties is sequentially gripped by tie clamp 39 and pulled completely out of track 12 by operation of lateral displacement drive 113 (FIG. 8). Tie pulling devices 36, 37 operate in tandem to withdraw two old ties at the same time. Again, tie pulling device 36, 37 remain stationary with respect to track 12 during each tie pulling operation while machine frame 14 advances continuously. Each completely withdrawn tie 47 is lifted onto rails 11 of track 12 by vertically adjusting tie gripping clamp 39, whereupon the next tie withdrawal operation is initiated. The old ties 47 placed on the track are picked up by two vertically adjustable lifting hooks 147 at the rear end of work vehicle 3 and transferred to conveying chain 44 which vertically conveys the old ties to collecting station 46 until a row of, for example 6, ties has been formed. The row of old ties is then gripped by tie retaining ledges 89 of power-driven crane 89 and transported thereby to stack 58 on machine frame 15 of third work vehicle 4.

The ballast in the section of the track bed from which old ties 47 have been withdrawn is smoothed or planed by ballast clearing and planing device 48 carried by work vehicle 4. For this purpose, shovel-shaped ballast clearing elements 54 are transversely and longitudinally displaced by operation of drives 52, 53 to displace the ballast towards the track shoulders. This operation is controlled by an operator in cab 49 and, after the ballast clearing and planing operation has been completed, device 48 is displaced by operation of drive 55 from its rearmost position shown in chain-dotted lines to its forward end position shown full lines in FIG. 3. The following ballast clearing and planing operation is then effected in this position.

New ties 66 transported by power-driven crane 82 to the front end of fourth work vehicle 5 are placed on the rails 11 of track 12 by operating tie gripping device 64 to grip the rearmost of a row of new ties at storage station 63 and to move it onto conveyor chain 62 which lowers the tie onto hook 65 which places the tie onto the rails. This tie is then gripped respectively by tie inserting device 68 or 69 while machine frame 16 continuously advances. The tie inserting operation proceeds in the same manner, but in reverse to, the tie withdrawal operation described hereinabove, devices 68 and 69 operating simultaneously with sequential groups of new ties and being controlled by an operator on seat 67. As soon as the tie inserters have reached their rear end position, indicated in dash-dotted lines in FIG. 3, the operator actuates drive 70 to displace the tie inserting device longitudinally in its front end position shown in full lines. After the new tie has been fully inserted, ballast is tamped under it by tamping device 72 as the tamping device moves relatively to continuously advancing work vehicle 5, i.e. remains stationary with respect to the track. As soon as the tamping device has reached its rear end position, indicated by dash-dotted lines in FIG. 3, the operator in cab 78 actuates drive 73 to move it rapidly back into the front end position indicated in full lines. In this position, the next tie positioning and tamping operation is performed. When the train moves from one operating site to another, tamping device 72 as well as ballast clearing devices 25, 48 are connected to the respective machine frames by coupling rods 148 (shown in dash-dotted lines) to move these devices with the work vehicles.

While train 1 advances non-stop along the operating site and independently of the operation of the individual tie exchange devices described hereinabove, motor crane 82 transports stacks of new ties along guide track 81 atop the train to storage place 59 immediately preceding vertical tie conveyor 60 at the front end of machine frame 16. When the motor crane 82 returns to freight car 6, it picks up stack 58 of old ties, which has been placed above swivel truck 9 supporting the rear end of machine frame 14 and the front end of machine frame 15 of second and third work vehicles 3 and 4.

What is claimed is:

1. A mobile apparatus for sequentially exchanging selected consecutive groups of old ties in an existing railroad track for groups of new ties while retaining groups of old ties therebetween to support the mobile apparatus on the track, which comprises (a) at least one bridge-like work vehicle having a machine frame defining an upwardly recessed portion between respective ends thereof, (b) a respective swivel truck supporting each machine frame end, (c) drive means for the continuous advancement of the work vehicle on the railroad track in an operating direction, (d) a continuous guide track mounted atop the work vehicle, (e) a power-driven crane mounted for mobility on the guide track and including (1) means for receiving ties for transport by the crane, (f) a succession of different individual devices mounted in the recessed portion of the work vehicle machine frame and operative to effectuate different sequential operations for exchanging the selected old ties for the new ties, the tie exchanging devices including in sequence in the operating direction (1) a spike pulling device, (2) a spike collecting device for collecting the pulled spikes, (3) a ballast clearing device including railroad track lifting means and means for laterally moving the old ties wherefrom the spikes have been pulled, (4) a tie plate transporting device, (5) a tie pulling device for laterally withdrawing the laterally moved old ties from the railroad track and a vertical conveyor succeeding the tie pulling device for conveying the withdrawn old ties, (6) a tie inserting device for inserting the new ties and a vertical conveyor preceding the tie inserting device for conveying the new ties thereto, and (7) a device for tamping ballast under the inserted new ties, and (g) a respective drive for displacing each tie exchanging device with respect to the work vehicle machine frame along a displacement path extending in the direction of the longitudinal extension of the work vehicle machine frame.

2. The mobile apparatus of claim 1, wherein the drive means is a drive mounted on the work vehicle whereby the work vehicle is self-propelled.

3. The mobile apparatus of claim 1, wherein the drive means comprises a driven tie transport car whereto the work vehicle is coupled.

4. The mobile apparatus of claim 1, wherein the tie exchanging devices further include another ballast clearing device arranged between the tie pulling and tie inserting devices.

5. The mobile apparatus of claim 1, wherein the tie tamping device includes a rotary ballast broom.

6. The mobile apparatus of claim 1, further comprising a plurality of open-top freight cars for loading the ties, each freight car having two parallel side walls with top edges extending in the direction of the railroad track and the continuous guide track extending over the top edges, the freight cars being coupled to the work vehicle to form a train, and the crane is a gantry crane, the tie receiving means comprising four L-shaped gripper arms, each gripper arm being rotatable about and vertically adjustable along a vertical axis for cooperatively subtending and thereby supporting a stack of the ties.

7. The mobile apparatus of claim 1, comprising a further power-driven crane mounted for mobility on the guide track, the crane being a gantry crane and including two vertically adjustable parallel retaining ledges extending in the direction of the railroad track and pivotal towards and away from each other about axes extending in said direction for respectively gripping and releasing a layer of adjacent ones of said ties, and drive means for pivoting the tie retaining ledges.

8. The mobile apparatus of claim 1, comprising a succession of at least four of said work vehicles coupled together and mounting respective ones of said individual tie exchanging devices.

9. The mobile apparatus of claim 8, wherein a first one of the bridge-like work vehicles in the operating direction carries the spike pulling device, the spike collecting device for collecting the pulled spikes and the ballast clearing device, the spike pulling and spike collecting devices and the ballast clearing device being track-bound, the spike pulling device being equipped with an operator's seat and the ballast cleaning device being self-propelled and equipped with an operator's cab, a second one of the work vehicles carries the tie plate transporting device and the tie pulling device with the succeeding vertical conveyor, the tie pulling device being equipped with an operator's seat, a fourth one of the work vehicles carries the tie inserting device with the preceding vertical conveyor and the device for tamping ballast under the inserted new ties, the ballast tamping device being track-bound and including a rotary ballast broom, and a third one of the work vehicles carries a self-propelled ballast clearing device for clearing and planing ballast serving to support the new ties and filling cribs therebetween, the ballast clearing device including an operator's cab and the ends of the machine frame of the third work vehicle being respectively pivoted to a rear one of the swivel trucks of the second work vehicle and a front one of the swivel trucks of the fourth work vehicle, and a storage space for the selected old ties and the new ties respectively arranged above the rear and front swivel trucks.

10. The mobile apparatus of claim 9, further comprising another operator's cab arranged on the machine frame of the fourth work vehicle, the ballast tamping device preceding the other operator's cab within view thereof.

11. The mobile apparatus of claim 9, wherein the second work vehicle carries two successive ones of said tie pulling devices and the fourth work vehicle carries two successive ones of said tie inserting devices.

12. The mobile apparatus of claim 1, wherein the ballast clearing device comprises a track-bound frame and at least two power-driven, transversely, longitudinally and vertically adjustable ballast clearing tools mounted on the frame.

13. The mobile apparatus of claim 12, wherein the railroad track lifting means and the means for laterally moving the old ties wherefrom the spikes have been pulled are mounted between the ballast clearing tools on the frame, the means for laterally moving the old ties comprising a transversely displaceable hook arranged for engagement with an end of a respective one of the ties for pushing the tie.

14. The mobile apparatus of claim 1, wherein the tie pulling and inserting devices each comprises a carrier frame longitudinally displaceably mounted in the recessed machine frame portion, a gripping means for gripping an end of a respective one of the ties, the tie end gripping means including a tie clamp and a drive for operating the tie clamp, a transversely extending guide element telescopingly and displaceably receiving the tie end gripping means, a vertical adjustment drive connecting the guide element to the carrier frame and a transverse adjustment drive connecting the tie end gripping means to the guide element whereby the tie end gripping means is vertically and transversely adjustable.

15. The mobile apparatus of claim 14, further comprising a hook arranged below the tie clamp and having a tie end lifting part projecting towards the tie clamp.

16. The mobile apparatus of claim 14, further comprising two rail lifting devices, the tie end gripping means being arranged between the two rail lifting devices, and a hook arranged at a side of the carrier frame transversely opposite the tie gripping means for pressing against an end of the tie opposite the gripped tie end, the hook transmitting a pushing force against the tie in the direction of the gripped tie end.

17. The mobile apparatus of claim 1, wherein the ballast tamping device comprises a track-bound carrier frame including a centrally projecting pole connected to the respective longitudinal displacing drive, a respective tamping tool assembly associated with each rail, each assembly including pairs of reciprocatory and vibratory tamping tools, a rotary ballast broom preceding the tamping tool assemblies in the operating direction, a drive for rotating the ballast broom about a transversely extending axis, and a drive for vertically adjusting the rotary ballast broom with respect to the carrier frame.

18. The mobile apparatus of claim 17, further comprising an undercarriage having flanged wheels engaging the rails and supporting a trailing end, in the operating direction, of the carrier frame on the railroad track, and the longitudinal displacing drive connecting a front end of the pole of the carrier frame to the upwardly recessed machine frame portion.

19. The mobile apparatus of claim 1, wherein each swivel truck has two axles spaced from each other in the operating direction by a distance corresponding to at least three cribs widths.

20. The mobile apparatus of claim 19, further comprising a track gage retaining means arranged between the axles of each swivel truck, the track gage engaging means including guide elements engaging both rails.

* * * * *